US010369589B2

(12) United States Patent
Dale

(10) Patent No.: US 10,369,589 B2
(45) Date of Patent: Aug. 6, 2019

(54) NOZZLE ADAPTER

(71) Applicant: Alan Dale, Taunton (GB)

(72) Inventor: Alan Dale, Taunton (GB)

( * ) Notice: Subject to any disclaimer, the term of this patent is extended or adjusted under 35 U.S.C. 154(b) by 186 days.

(21) Appl. No.: 15/593,632

(22) Filed: May 12, 2017

(65) Prior Publication Data

US 2018/0326449 A1 Nov. 15, 2018

(51) Int. Cl.
*B05C 17/00* (2006.01)
*B05C 17/005* (2006.01)

(52) U.S. Cl.
CPC .. *B05C 17/00516* (2013.01); *B05C 17/00509* (2013.01); *B05C 17/00513* (2013.01)

(58) Field of Classification Search
CPC ..... B05C 17/00506; B05C 17/00509; B05C 17/00513; B05C 17/00516
USPC ..... 239/587.1
See application file for complete search history.

(56) References Cited

U.S. PATENT DOCUMENTS 3,439,839 A * 4/1969 Schumann ..... B05C 17/00516 222/183
3,448,896 A * 6/1969 Toru ..... B65D 35/12 222/568
4,258,884 A * 3/1981 Rogers ..... B05C 17/00516 222/570
4,382,530 A * 5/1983 Calisto ..... B65D 25/48 222/326
4,854,482 A * 8/1989 Bergner ..... B05C 17/005 222/94
4,957,225 A * 9/1990 Childers ..... B05C 17/00516 222/568
4,995,540 A * 2/1991 Colin ..... A61C 9/0026 222/132
5,049,071 A * 9/1991 Davis ..... A61C 17/0202 222/145.5
5,104,013 A * 4/1992 Hawley ..... B65D 35/38 222/566
D335,809 S * 5/1993 Reifenberger ..... D8/70
5,228,599 A * 7/1993 Keller ..... B05C 17/00513 222/137
5,248,071 A * 9/1993 Ray ..... B65D 47/122 222/566

(Continued)

*Primary Examiner* — Viet Le
(74) *Attorney, Agent, or Firm* — Maier & Maier, PLLC

(57) ABSTRACT

A nozzle adapter for a caulking tube nozzle. Such a nozzle adapter includes a shoulder portion which has a hole into which a tapered nozzle of the caulking tube is inserted, a header portion which is protruded on the shoulder portion and configured to engage with an external nozzle which the user may select depending on a working environment; and a clutch plate which is provided under the shoulder portion and configured to engage with the tapered nozzle and fix the hole of the shoulder portion at the tapered nozzle. The header portion, the shoulder portion and the clutch plate forms an internal passageway through which the tapered nozzle is inserted and a caulking material flow from the tapered nozzle of the caulk tube to the external nozzle. Accordingly, the nozzle adapter is attached to a tapered nozzle of caulking tube or gun, and enables the user to select various taper dimensions or angles of external nozzles by engaging the external nozzle with the nozzle adapter which is attached to the caulking tube nozzle.

15 Claims, 4 Drawing Sheets

(56) References Cited

U.S. PATENT DOCUMENTS 5,249,716 A * 10/1993 O'Sullivan ..... B05C 17/00516 222/326
5,263,607 A * 11/1993 Temesvary ..... A47K 10/3818 221/304
5,301,840 A * 4/1994 Sun ..... B65D 25/54 222/109
5,312,384 A * 5/1994 Temple ..... A61F 5/44 604/355
5,462,317 A * 10/1995 Keller ..... B05C 17/00506 222/566
5,722,829 A * 3/1998 Wilcox ..... A61C 9/0026 222/137
5,833,099 A * 11/1998 Boaz ..... B05C 17/00516 222/568
6,179,506 B1 * 1/2001 Dewberry ..... B05C 17/00516 222/567
6,824,026 B1 * 11/2004 Boutwell ..... B65D 41/22 222/326
7,014,079 B2 * 3/2006 Swann ..... B05C 17/00516 222/326
7,021,505 B2 * 4/2006 Franczyk ..... A21C 15/005 222/541.1
7,163,130 B2 * 1/2007 Lafond ..... B05C 17/00503 222/326
7,431,587 B2 * 10/2008 Pond ..... A61C 3/005 433/80
7,661,606 B2 * 2/2010 Vacher ..... B05B 7/0815 239/296
8,647,006 B2 * 2/2014 Greer, Jr. ..... B05C 17/002 401/183
8,985,402 B2 * 3/2015 Schneider ..... B65D 47/06 222/330
8,991,662 B2 * 3/2015 Milan ..... B05C 17/00506 222/327
9,475,625 B2 * 10/2016 Di Molfetta ..... B65D 51/00
9,943,876 B2 * 4/2018 Haynes ..... B65D 83/0022
10,113,669 B2 * 10/2018 Logan ..... F16L 5/08
2004/0226968 A1 * 11/2004 Lafond ..... B05C 17/00506 222/327
2005/0184086 A1 * 8/2005 Raterman ..... B05C 5/027 222/1
2006/0163293 A1 * 7/2006 Peay ..... B05C 17/00509 222/611.1
2010/0247225 A1 * 9/2010 Zhang ..... B05C 17/00503 401/266
2011/0031325 A1 * 2/2011 Perkins ..... B05B 3/0486 239/1
2011/0089192 A1 * 4/2011 McMahon ..... B05C 17/00516 222/82
2011/0174836 A1 * 7/2011 Summons ..... B05C 17/003 222/129
2012/0061343 A1 * 3/2012 Habibi-Naini ..... B65D 50/041 215/222
2012/0091172 A1 * 4/2012 Maier ..... B05C 17/00503 222/566
2012/0256018 A1 * 10/2012 Lange ..... B05B 3/0427 239/587.1
2013/0112778 A1 * 5/2013 Hiemer ..... B05B 7/04 239/398
2013/0214013 A1 * 8/2013 Milan ..... B05C 17/00506 222/538
2014/0110432 A1 * 4/2014 Hanten ..... B65D 33/1641 222/83
2014/0117041 A1 * 5/2014 Springhorn ..... B05C 17/00586 222/83
2016/0296962 A1 * 10/2016 Maxa ..... B05C 17/00513
2016/0296963 A1 * 10/2016 Dean ..... B65D 39/0052
2017/0205009 A1 * 7/2017 Pappalardo ..... F16L 37/101
2017/0259232 A1 * 9/2017 Vogt ..... A61B 17/8825
2017/0274414 A1 * 9/2017 Ruhstaller ..... B05C 17/00513
2018/0116244 A1 * 5/2018 Takakuta ..... A23G 3/28
2018/0117623 A1 * 5/2018 Robinson ..... B05C 17/00513
2018/0177569 A1 * 6/2018 Bublewitz ..... A61M 35/003
2018/0326449 A1 * 11/2018 Dale ..... B05C 17/00516

* cited by examiner

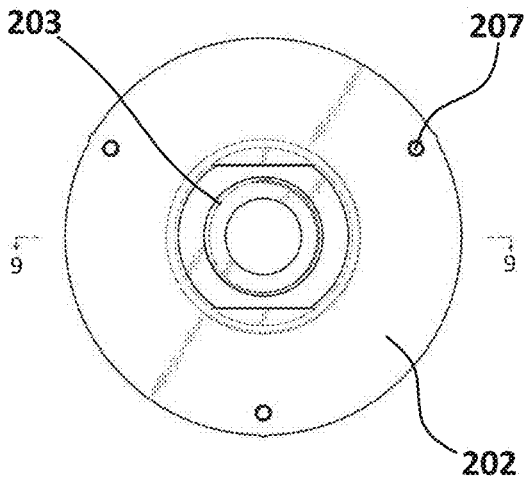
Fig. 3-A
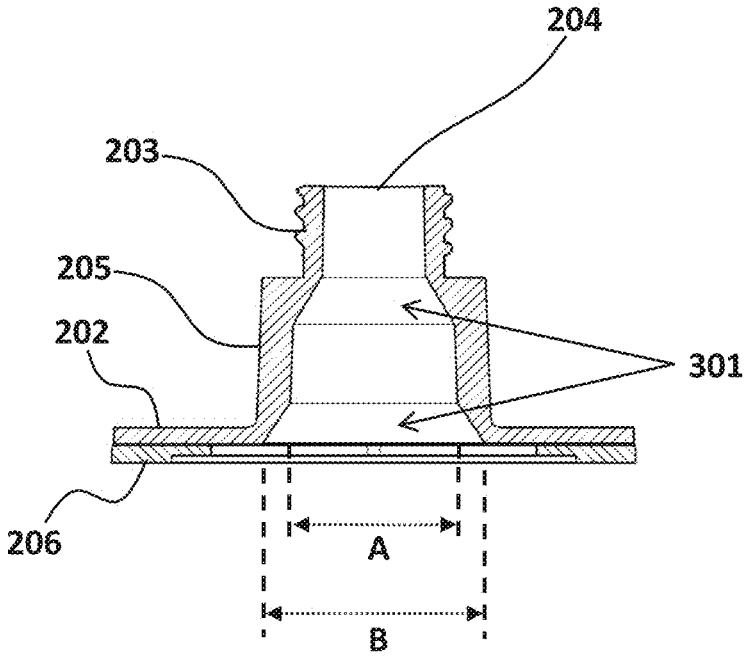
Fig. 3-B

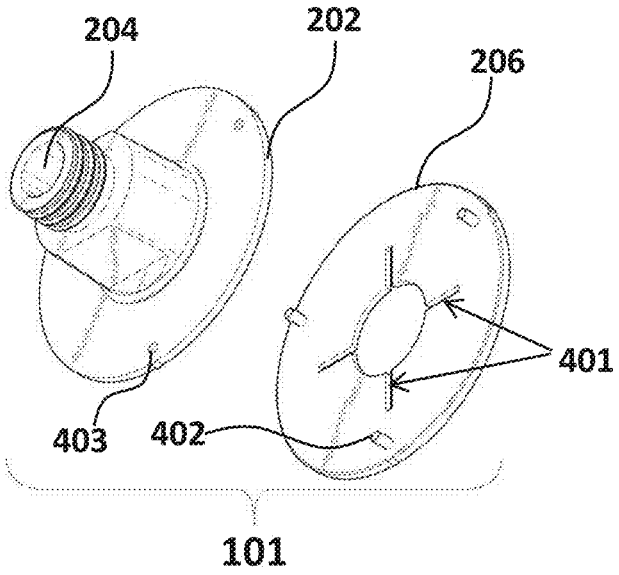
Fig. 4-A
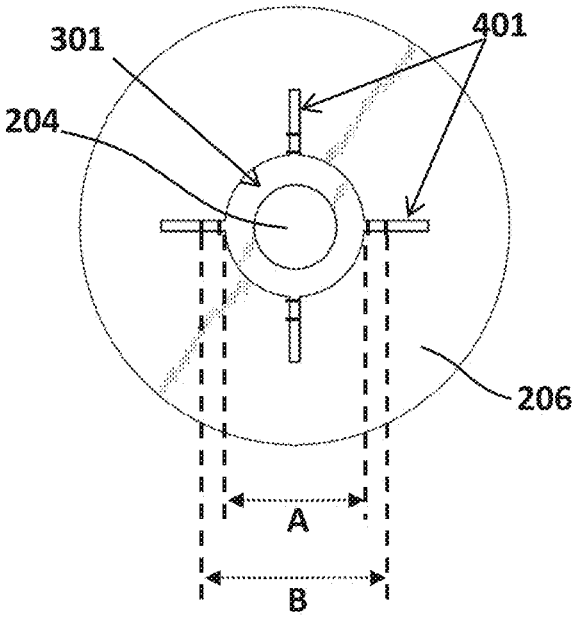
Fig. 4-B

NOZZLE ADAPTER

BACKGROUND

Caulking is to seal a certain structure where air, water, or noise may be leaked through a joint or a seam of the structure. Generally, a caulk tube or a caulk gun which cradles the caulk tube is used for the caulking. Such a caulk tube usually has a nozzle which is tapered from its base end to a point at its top end, but the taper dimension of the nozzle can vary depending on its manufacturer. The caulking could require a certain condition such as a certain taper dimension of the caulk tube's nozzle or a certain angle of the nozzle depending on a working environment. Thus, it would be beneficial for a user if the user can change the nozzle of the caulk tube as the user desires.

SUMMARY

According to at least one exemplary embodiment, a nozzle adapter may be described. Such a nozzle adapter may be attached to a tapered nozzle of caulking tube or gun, and enable the user to select various taper dimensions or angles of external nozzles by engaging the external nozzle with the nozzle adapter which is attached to the caulking tube nozzle.

Such a nozzle adapter may include: a shoulder portion having a hole into which a tapered nozzle is inserted; a header portion protruded on the shoulder portion, having an end hole and configured to engage with an external object; and a clutch plate provided under the shoulder portion and configured to engage with the tapered nozzle and fix the hole of the shoulder portion at the tapered nozzle. According to an exemplary embodiment, the header portion, the shoulder portion and the clutch plate may form an internal passageway through which the tapered nozzle is inserted and a material flow from the tapered nozzle to the external object, and the internal passageway may have one or more tapered sections which allows the tapered nozzle to be adjusted in the internal passageway without a gap.

According to an exemplary embodiment, the nozzle adapter may further includes a neck portion provided between the shoulder portion and the header portion, the clutch plate may be detachable from the shoulder portion, and the clutch plate may be attached to the shoulder portion via a plurality of pins and a plurality of pin holes. Also, in an exemplary embodiment, the clutch plate may be fixed at the tapered nozzle and detachable from the shoulder portion, the clutch plate may have a plurality of equidistant slots to fix the hole of the shoulder portion at the tapered nozzle. Further, in an exemplary embodiment, the number of the equidistant slots may be at least four to fix the hole of the shoulder portion at the tapered nozzle, and the equidistant slots may be made of polypropylene as membranes to fix the hole of the shoulder portion at the tapered nozzle.

According to an exemplary embodiment, the header portion may have a screw thread for the engagement with the external object. In another exemplary embodiment, the engagement may be made via a bayonet fit, a clip fit and/or any other engagement means as well as the screw thread. Also, in an exemplary embodiment, the tapered nozzle may be a caulk tube nozzle, and the external object is an external nozzle which the user selects depending on a working environment.

BRIEF DESCRIPTION OF THE FIGURES

Advantages of embodiments of the present invention will be apparent from the following detailed description of the exemplary embodiments thereof, which description should be considered in conjunction with the accompanying drawings in which like numerals indicate like elements, in which:

Exemplary FIG. 1 may show an exemplary embodiment of a nozzle adapter which is to be attached to a nozzle of a caulk tube;

Figure 2:
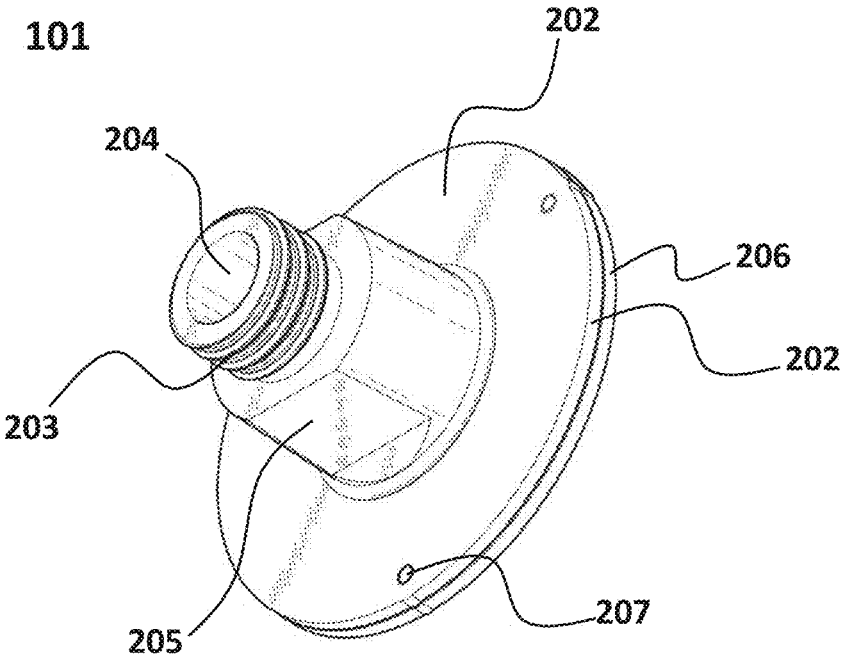

Exemplary FIG. 2 may show an exemplary embodiment of a nozzle adapter in perspective view;

Exemplary FIG. 3-A may show an exemplary embodiment of a nozzle adapter in a top view;

Exemplary FIG. 3-B may show an exemplary embodiment of a nozzle adapter in a cross-sectional view along line 9-9 of FIG. 3-A;

Exemplary FIG. 4-A may show an exemplary embodiment of a nozzle adapter in an exploded perspective view; and Exemplary FIG. 4-B may show an exemplary embodiment of a nozzle adapter in a bottom view.

DETAILED DESCRIPTION OF THE EMBODIMENTS

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation.

According to an exemplary embodiment, and referring to the Figures generally, a nozzle adapter may be disclosed. According to an exemplary embodiment, such a nozzle adapter may be attached to a tapered nozzle of caulking tube or gun, and enable the user to select various taper dimensions or angles of external nozzles by engaging the external nozzle with the nozzle adapter which is attached to the caulking tube nozzle.

Figure 1:
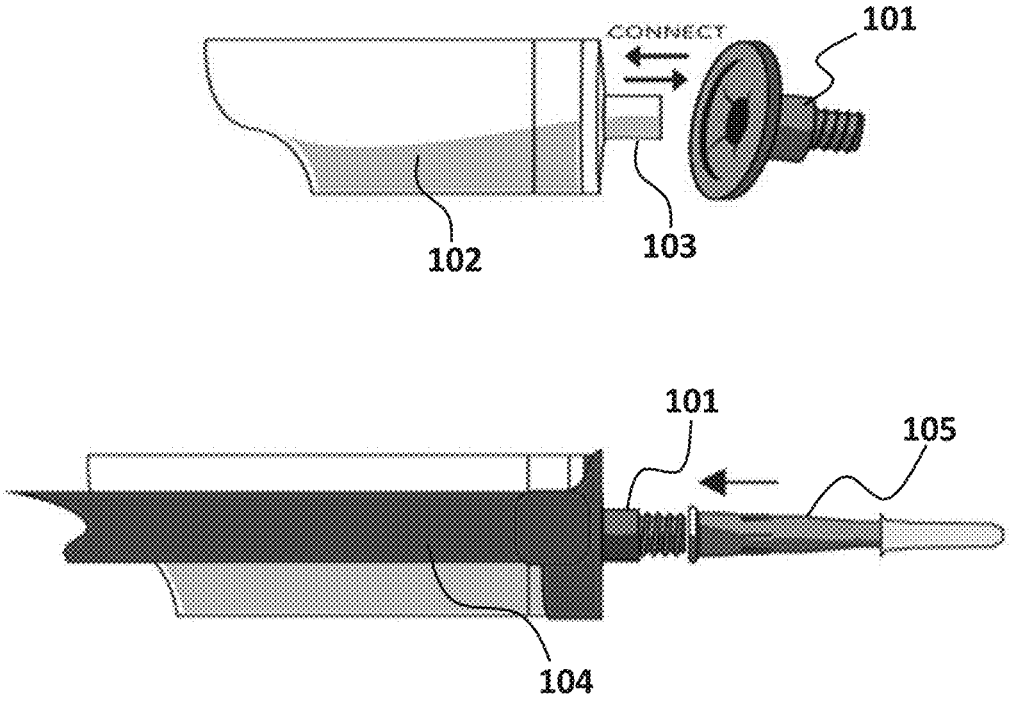

Referring to exemplary FIG. 1, according to an exemplary embodiment, the nozzle adapter 101 may have a hole at the bottom for the nozzle 103 of the caulking tube 102 to be inserted into the hole at the bottom of the nozzle adapter 101. Also, in an exemplary embodiment, at the nozzle adapter 101, the external nozzle 105 may be engaged as the user selects the dimension or angles of the external nozzle 105. Further, in an exemplary embodiment, the caulk gun 104 may be used together with the nozzle adapter 101. According to an exemplary embodiment, the nozzle adapter 101 may be attached and fixed at the nozzle 103 of the caulking tube 102 by itself, and the nozzle adapter 101 may also be locked with the nozzle 103 of the caulking tube 102 by the cradle of the caulk gun 104.

Now turning to exemplary FIG. 2, FIG. 2 shows an exemplary embodiment of a nozzle adapter 101 in perspective view. According to an exemplary embodiment, the nozzle adapter 101 may include the shoulder portion 202 which has a hole into which the tapered nozzle 103 of the caulking tube 102 is inserted. Also, in an exemplary embodiment, the nozzle adapter 101 may include the header portion 203 which is protruded on the shoulder portion 202 having the end hole 204. According to an exemplary embodiment, the header portion 203 may be configured to engage with the external nozzles 105 which may have various taper dimensions or angles. For the engagement, the header portion 203 may have a screw thread, a bayonet fit, a clip fit, or any other engagement mechanism. As shown in the exemplary FIG. 2, the neck portion 205 may be provided between the header portion 203 and the shoulder portion 202 as a grip to be held by the user. However, in another exemplary embodiment, the nozzle adapter 101 may not include the neck portion 205 between the header portion 203 and the shoulder portion 202, and the header portion 203 may be protruded on the shoulder portion 202.

Referring still to FIG. 2, according to an exemplary embodiment, the nozzle adapter 101 may also include the clutch plate 206 which is provided under the shoulder portion 202 and configured to engage with the tapered nozzle 103 of the caulking tube 102 and to fix the hole of the shoulder portion 202 at the tapered nozzle 103. In an exemplary embodiment, the clutch plate 206 may be attached to the shoulder portion 202 via a connecting measure 207. According to an exemplary embodiment, the connecting measure 207 may be a pin and a pin hole, and the pins may be plastic welded. Also, in another exemplary embodiment, the connecting measure 207 may be a clip-together process. Such a connecting measure 207 is not limited to a specific type, however, and can be any kind of connecting means, method, or device, as desired.

Now turning to exemplary FIG. 3-A, FIG. 3-A shows an exemplary embodiment of a nozzle adapter in a top view. According to an exemplary embodiment, the header portion 203 may be protruded on the center position of the shoulder portion 202 to form a passageway internally through which the tapered nozzle 103 of the caulking tube 102 is inserted and a material may flow from the tapered nozzle 103 to the external nozzle 105.

Now turning to exemplary FIG. 3-B, FIG. 3-B shows an exemplary embodiment of a nozzle adapter in a cross-sectional view along line 9-9 of FIG. 3-A. According to an exemplary embodiment, the header portion 203, the neck portion 205, the shoulder portion 202 and the clutch plate 206 may form the passageway internally through which the tapered nozzle 103 of the caulking tube 102 is inserted and a material may flow from the tapered nozzle 103 to the external nozzle 105. In another exemplary embodiment, the clutch plate 206 may be detachable from the shoulder portion 202 and/or fixed at the tapered nozzle 103 of the caulking tube 102. Also, in another exemplary embodiment, the nozzle adapter 101 may not include the neck portion 205 between the header portion 203 and the shoulder portion 202, and the header portion 203 may be protruded on the shoulder portion 202.

Referring still to FIG. 3-B, according to an exemplary embodiment, the diameter (A) of the clutch plate's hole may be smaller than the diameter (B) of the shoulder portion's hole. In an exemplary embodiment, the shoulder portion's hole (B) may be large enough for any kinds of the tapered nozzle 103 of the caulking tube 102 to be inserted, and the clutch plate's hole (A) may be small enough to engage with the tapered nozzle 103 of the caulking tube 102 and to fix the hole of the shoulder portion 202 at the tapered nozzle 103.

Referring still to FIG. 3-B, according to an exemplary embodiment, the passageway which is formed internally through the header portion 203, the neck portion 205, the shoulder portion 202 and the clutch plate 206 may have tapered sections 301 for the tapered nozzle 103 of the caulking tube 102 to be inserted and adjusted without a gap so that the material cannot leak out and can flow out to the end hole 204 of the header portion 203 without any loss or leak. The exemplary FIG. 3-B shows two tapered sections 301, but the number of tapered sections may be more than two considering the size of the tapered nozzle 103 of the caulking tube 102 could be vary.

Now turning to exemplary FIG. 4-A, FIG. 4-A shows an exemplary embodiment of a nozzle adapter in an exploded perspective view. As described above, the clutch plate 206 may be attached to the shoulder portion 202 via a connecting measure 207. The exemplary FIG. 4-A shows the connecting measure 207 as a pin 402 on the clutch plate 206 and a pin hole 403 on the shoulder portion 202, but such a connecting measure 207 is not limited to a specific mean and can be any kinds of connecting means as desired.

Referring still to FIG. 4-A, according to an exemplary embodiment, the clutch plate 206 may have equidistant slots 401 for the clutch plate 206 to engage with the tapered nozzle 103 of the caulking tube 102 and to fix the hole of the shoulder portion 202 at the tapered nozzle 103. In an exemplary embodiment, the equidistant slots 401 may be a thin membranes so that the clutch plate 206 may push fitted over the tapered nozzle 103 of the caulking tube 102. Also, in an exemplary embodiment, the equidistant slots 401 may be made of a certain material which have a flexibility such as the polypropylene for the equidistant slots 401 to be flexibly fitted and fixed at the tapered nozzle 103 of the caulking tube 102. The exemplary FIG. 4-A shows four equidistant slots 401, but the number of the equidistant slots 401 may be more than four, for example, sixteen or more.

Now turning to exemplary FIG. 4-B, FIG. 4-B shows an exemplary embodiment of a nozzle adapter in a bottom view. As described above, the diameter (A) of the clutch plate's hole may smaller than the diameter (B) of the shoulder portion's hole. The exemplary FIG. 4-B shows that the clutch plate's hole (A) is smaller than the shoulder portion's hole (B). According to an exemplary embodiment, the end hole 204 may be smaller than the clutch plate's hole (A) so that the tapered section 301 of the internal passageway may be seen in the bottom view of the nozzle adapter 101. Also, as described above, the shoulder portion's hole (B) may be large enough for any kinds of the tapered nozzle 103 of the caulking tube 102 to be inserted, and the clutch plate's hole (A) may be small enough to engage with the tapered nozzle 103 of the caulking tube 102 and to fix the hole of the shoulder portion 202 at the tapered nozzle 103.

The foregoing description and accompanying drawings illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A nozzle adapter comprising:

a shoulder portion having a hole into which a tapered nozzle is inserted;

a header portion protruded on the shoulder portion, having an end hole and configured to engage with an external object; and a clutch plate provided under the shoulder portion and configured to engage with the tapered nozzle and fix the hole of the shoulder portion at the tapered nozzle, wherein the clutch plate is attached to the shoulder portion via a plurality of pins and a plurality of pin holes, wherein the header portion, the shoulder portion and the clutch plate form an internal passageway through which the tapered nozzle is inserted and a material flows from the tapered nozzle to the external object.

2. The nozzle adapter of claim 1, wherein the nozzle adapter further comprises a neck portion provided between the shoulder portion and the header portion.

3. The nozzle adapter of claim 1, wherein the clutch plate is detachable from the shoulder portion.

4. The nozzle adapter of claim 1, wherein the clutch plate is fixed at the tapered nozzle and detachable from the shoulder portion.

5. The nozzle adapter of claim 1, wherein the clutch plate has a plurality of equidistant slots to fix the hole of the shoulder portion at the tapered nozzle.

6. The nozzle adapter of claim 1, wherein the clutch plate has at least four equidistant slots to fix the hole of the shoulder portion at the tapered nozzle.

7. The nozzle adapter of claim 1, wherein the clutch plate has a plurality of equidistant slots that are made of polypropylene as membranes to fix the hole of the shoulder portion at the tapered nozzle.

8. The nozzle adapter of claim 1, wherein the header portion has a screw thread for the engagement with the external object.

9. The nozzle adapter of claim 1, wherein the header portion has a bayonet fit for the engagement with the external object.

10. The nozzle adapter of claim 1, wherein the header portion has a clip fit for the engagement with the external object.

11. The nozzle adapter of claim 1, wherein the internal passageway has at least one of a plurality of tapered sections which allows the tapered nozzle to be adjusted in the internal passageway without a gap.

12. The nozzle adapter of claim 1, wherein the tapered nozzle is a caulk tube nozzle.

13. The nozzle adapter of claim 1, wherein the external object is an external nozzle.

14. A nozzle adapter comprising:

a shoulder portion having a hole into which a tapered nozzle is inserted;

a header portion protruded on the shoulder portion, having an end hole and configured to engage with an external object; and a clutch plate provided under the shoulder portion and configured to engage with the tapered nozzle and fix the hole of the shoulder portion at the tapered nozzle, wherein the clutch plate has a plurality of equidistant slots to fix the hole of the shoulder portion at the tapered nozzle, and wherein the header portion, the shoulder portion and the clutch plate form an internal passageway through which the tapered nozzle is inserted, and a material flows from the tapered nozzle to the external object.

15. A nozzle adapter comprising:

a shoulder portion having a hole into which a tapered nozzle is inserted;

a header portion protruded on the shoulder portion, having an end hole and configured to engage with an external object; and a clutch plate provided under the shoulder portion and configured to engage with the tapered nozzle and fix the hole of the shoulder portion at the tapered nozzle, wherein the clutch plate has a plurality of equidistant slots that are made of polypropylene as membranes to fix the hole of the shoulder portion at the tapered nozzle, and wherein the header portion, the shoulder portion and the clutch plate form an internal passageway through which the tapered nozzle is inserted, and a material flows from the tapered nozzle to the external object.

* * * * *